United States Patent [19]

Moscoe et al.

[11] Patent Number: 4,860,819

[45] **Date of Patent: * Aug. 29, 1989**

[54] CONTINUOUS CASTING TUNDISH AND ASSEMBLY

[75] Inventors: Gerald F. Moscoe; Joel C. Mastervich, both of Crown Point; William J. Kreevich, St. John; John R. Knoepke, Munster, all of Ind.; Daniel Rellis, Jr., Lansing, Ill.; Roger J. Glennon; Howard M. Pielet, both of Munster, Ind.

[73] Assignee: Inland Steel Company, Chicago, Ill.

[ * ] Notice: The portion of the term of this patent subsequent to May 9, 2006 has been disclaimed.

[21] Appl. No.: 263,363

[22] Filed: Oct. 27, 1988

Related U.S. Application Data

[60] Division of Ser. No. 65,042, Jun. 22, 1987, which is a continuation-in-part of Ser. No. 808,570, Dec. 13, 1985.

[51] Int. Cl.[4] ..... B22D 1/00

[52] U.S. Cl. ..... 164/437; 164/337; 222/591

[58] Field of Search ..... 164/134, 337, 437, 488, 164/490; 222/591; 75/46, 53, 51.7

[56] References Cited

U.S. PATENT DOCUMENTS 412,154 11/1978 Muller et al. ..... 164/437

*Primary Examiner*—Richard K. Seidel

*Attorney, Agent, or Firm*—Marshall, O'Toole, Gerstein, Murray & Bicknell

[57] ABSTRACT

A tundish and associated assembly are employed for the continuous casting of molten steel containing lead. Undissolved lead can accumulate at the bottom of the tundish, work its way through the refractory material lining the tundish interior bottom and weep through the metal tundish shell bottom into a casting mold located below the tundish, which is undesirable. Expedients are provided to minimize such lead weeping.

2 Claims, 3 Drawing Sheets

10
11
12
13
14
15
16
17
20
21
22
24
25
26
27
28
30
31
32
44
45
66
67
68
69
71
72
73
74
75
76
77
78
79
80

CONTINUOUS CASTING TUNDISH AND ASSEMBLY

RELATED APPLICATION

This is a division of application Ser. No. 65,042 filed June 22, 1987. Ser. No. 65,042 is a continuation-in-part of Jackson et al. U.S. application Ser. No. 808,570, filed Dec. 13, 1985 and entitled "Preventing Undissolved Alloying Ingredient From Entering Continuous Casting Mold"; and the disclosure of said application is incorporated herein by reference.

BACKGROUND OF THE INVENTION

The present invention relates generally to the continuous casting of molten metal, such as molten steel, and more particularly to preventing undissolved alloying ingredients denser than the molten metal from entering the continuous casting mold.

In the continuous casting of molten steel, a stream of molten steel is poured from a ladle into an intermediate vessel known as a tundish having a bottom containing outlet openings through which molten steel flows into a continuous casting mold.

The tundish is composed of a metal shell having a bottom and an opening in the bottom. Refractory material lines the interior of the shell bottom to form a tundish interior bottom, and there is a first interface between the shell bottom and the refractory lining.

A vertically disposed nozzle element, separate and discrete from the shell and the lining, extends through the refractory lining and the opening in the shell bottom. The refractory material surrounds at least a major part of the nozzle element, and there is a second interface between the refractory material and the nozzle element.

The continuous casting mold is located below the nozzle element for receiving molten metal flowing downwardly through the nozzle element.

Free machining steels contain lead and/or bismuth to improve the machinability of the steel. Typical contents for each are about 0.04–0.40 wt. % bismuth and 0.05–0.50 wt. % lead.

Lead or bismuth may be added to the stream of molten steel entering the tundish. Lead and bismuth have a relatively low solubility in molten steel, compared to other alloying ingredients added to molten steel, and lead and bismuth are denser than molten steel. Because of these properties, substantial amounts of undissolved lead and bismuth tend to accumulate at the bottom of the tundish. For purposes of discussion, reference will hereafter be made to lead alone, but the problems and solutions applicable to lead described herein are also applicable to bismuth.

It has been determined that, one way or another, liquid lead finds its way to either or both of the first or second interfaces in the tundish, and from there the lead weeps or drips out through the bottom of the tundish, with much, if not most, of the liquid lead drippings entering the continuous casting mold, and that is undesirable because it can have an adverse effect on the quality of the cast steel product, providing undesirable lead globules in the cast steel. Lead weeping also results in decreased recovery of the lead added to the steel, as well as being a health hazard.

The metal tundish shell is normally provided with a plurality of bottom weep holes spaced from the bottom opening in the tundish shell through which the nozzle element extends. The purpose of the weep holes is to drain moisture which may accumulate at the bottom of the tundish shell. This moisture originates in the refractory lining for the tundish shell, and the moisture accumulates when a new refractory lining dries. However, with regard to those weep holes which overlie the casting mold, liquid lead which finds it way to the interface between the tundish shell bottom and the refractory lining adjacent the weep holes, can drain through these weep holes into the casting mold. The weep holes through which liquid lead can drip into the casting mold are those which are nearest to the tundish shell's bottom opening through which the nozzle element extends.

The second interface, i.e., the interface between the nozzle element and the adjacent refractory material, defines a downwardly extending seepage path along which liquid lead can seep toward the casting mold.

Located directly below the nozzle element and communicating therewith is a flow gate for controlling the flow of molten metal from the tundish through the nozzle element to the casting mold.

The aforementioned Jackson et al. patent application, of which this application is a continuation-in-part, was directed to the problem of preventing undissolved lead which accumulated on the tundish interior bottom from being carried out through the outlet openings or nozzle elements in the tundish.

SUMMARY OF THE INVENTION

The present invention is directed to expedients for preventing liquid lead, which finds it way to either the first interface or the second interface in the tundish, from entering the continuous casting mold.

Among these expedients is the provision of a drip pan between the nozzle element and the casting mold, for catching lead dripping from the tundish.

In another expedient, structure is provided for sealing or closing the weep holes through which the undesired dripping into the casting mold occurs. In addition to sealing the weep holes adjacent the nozzle outlet openings in the tundish, any other openings in the tundish shell bottom which overlie the continuous casting mold are sealed shut.

A further expedient provides structure for slowing the movement of liquid lead along the seepage path at the second interface. Accordingly, by the time the liquid lead reaches a position along the seepage path where it could drip into the continuous casting mold, the casting operation has concluded and lead dripping is no longer as serious a problem as it was while the casting operation was being conducted.

Another expedient comprises structure which prevents lead seepage along the first interface, i.e., the interface between the tundish shell bottom and its refractory lining, from reaching the opening in the tundish shell bottom through which the nozzle element extends. This prevents liquid lead from dripping out of the tundish at the outside edges of that opening.

Surrounding the nozzle elements and embedded within the refractory material adjacent the nozzle element is a horizontally disposed shield composed of metal impervious to liquid lead. This shield prevents liquid lead from seeping downwardly through the refractory material adjacent the nozzle element to the first interface, between the tundish shell bottom and the refractory material lining the shell bottom.

Additional structure is provided within the tundish interior to prevent undissolved lead from accumulating adjacent the top outlet opening in the nozzle element.

Structure is also provided for preventing liquid lead which finds its way to the flow gate below the nozzle element from working its way through the flow gate into the casting mold.

In another expedient, the refractory lining in the area adjacent the tundish bottom opening is provided with a composition which increases the length of time required to saturate that lining with lead. This increases the length of time the tundish can be employed before the problem of substantial amounts of lead finding its way to the first interface becomes a problem.

By using the expedients of the present invention, the length of time in which a tundish may be employed before it has to be removed from operation is increased by about 50%. A tundish which has to be removed from operation must undergo extensive rehabilitation before it can be reemployed in a continuous casting operation. A rehabilitation procedure is costly, time-consuming and labor intensive. Employing expedients in accordance with the present invention reduces all of this by about 50%.

Other features and advantages are inherent in the structure claimed and disclosed or will become apparent to those skilled in the art from the following detailed description in conjunction with the accompanying diagramatic drawings.

DETAILED DESCRIPTION

Figures 1, 9:
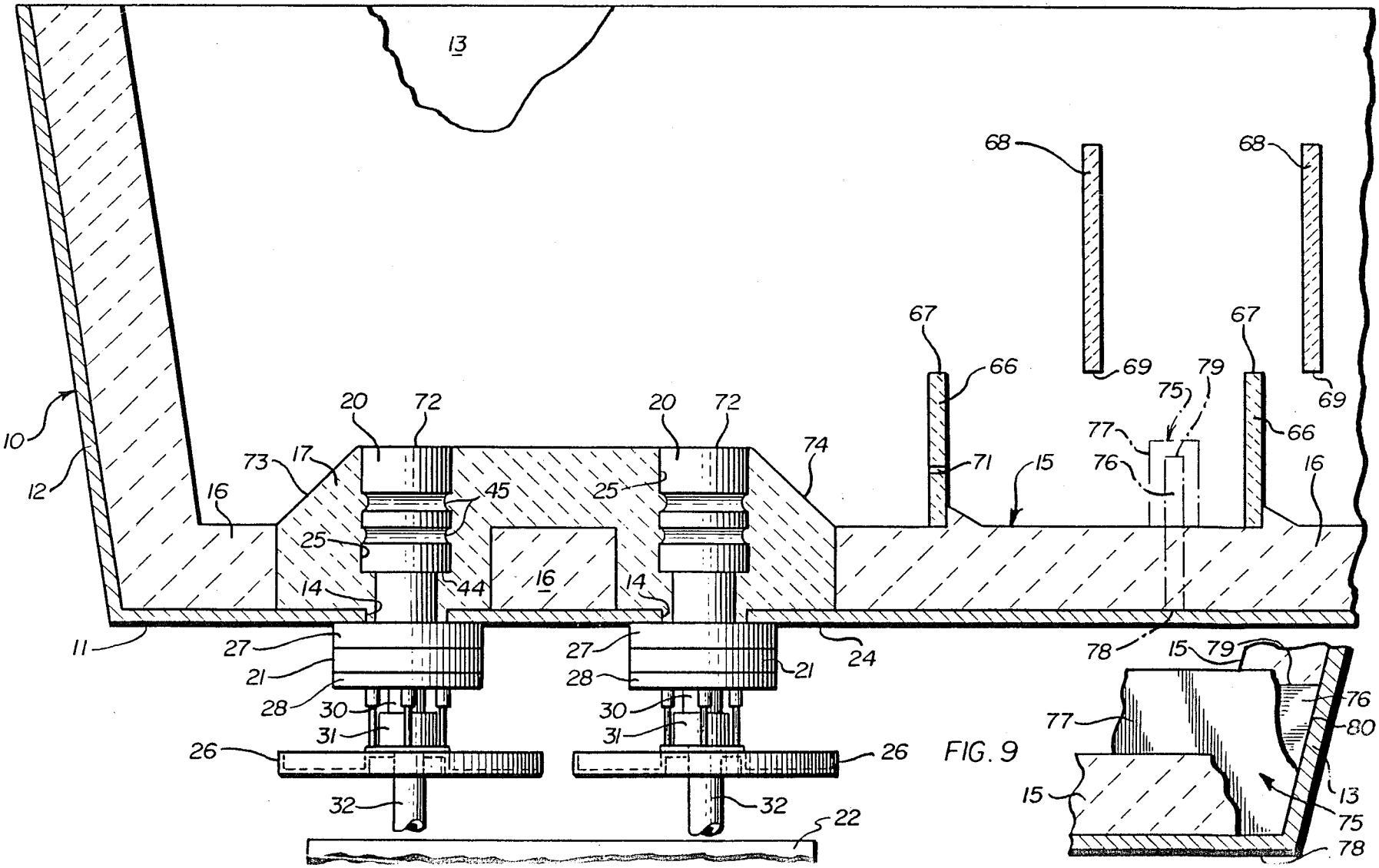
FIG. 1 is a fragmentary sectional view of a portion of a continuous casting tundish and assembly in accordance with an embodiment of the present invention.
FIG. 9 is a fragmentary sectional view of a portion of a tundish shell illustrating another expedient in accordance with the present invention.

Referring initially to FIG. 1 there is illustrated a continuous casting tundish and assembly in accordance with an embodiment of the present invention. The assembly comprises a metal tundish shell 10 having a bottom 11, a pair of end walls (only one of which is shown, at 12), and a pair of sidewalls (only one of which is shown, at 13). Bottom 11 has openings 14, 14. A refractory material 15 lines the interior of shell bottom 11 (as well as the rest of the tundish shell interior) to form a tundish interior bottom. Refractory lining 15 comprises a portion 16 including refractory blocks and a portion 17 composed of rammed refractory material located adjacent a pair of vertically disposed nozzle elements 20,20 each of which is separate and discrete from shell 10 and refractory lining 15 and each of which extends through the lining and through a bottom opening 14 in shell 10. At least a major part of each nozzle element 20 is surrounded by rammed refractory material 17 constituting part of refractory lining 15.

Molten metal, such as molten steel, is introduced into the tundish and flows outwardly therefrom through a nozzle 20 into a casting mold 22 located below nozzle elements 20,20 for receiving molten metal flowing downwardly through the nozzle elements. A flow gate 21 is located between each nozzle element 20 and casting mold 22 for controlling the flow of molten metal out of the tundish through a nozzle element 20.

There is a first interface 24 between shell bottom 11 and refractory lining 15. There is a second interface 25 between nozzle element 20 and the refractory material surrounding the nozzle element. When the molten metal within the tundish is molten steel to which lead has been added, there will be some undissolved lead in the molten steel, and this undissolved lead will find its way, in one manner or another, to either or both of the first and second interfaces 24, 25, respectively. Liquid lead at first interface 24 can drip downwardly out of the tundish through any opening in tundish shell bottom 11. Liquid lead at second interface 25 can follow a seepage path vertically downwardly along that interface through opening 14 and shell bottom 11 and from there can drip downwardly either around the outside of or through gate 21. It is undesirable for the downwardly dripping lead to enter casting mold 22 for reasons previously described. Therefore, in accordance with the present invention, a number of expedients are provided, herein collectively called "lead control means", for preventing liquid lead, which finds it way to either first interface 24 or second interface 25, from entering casting mold 22.

Figure 2:
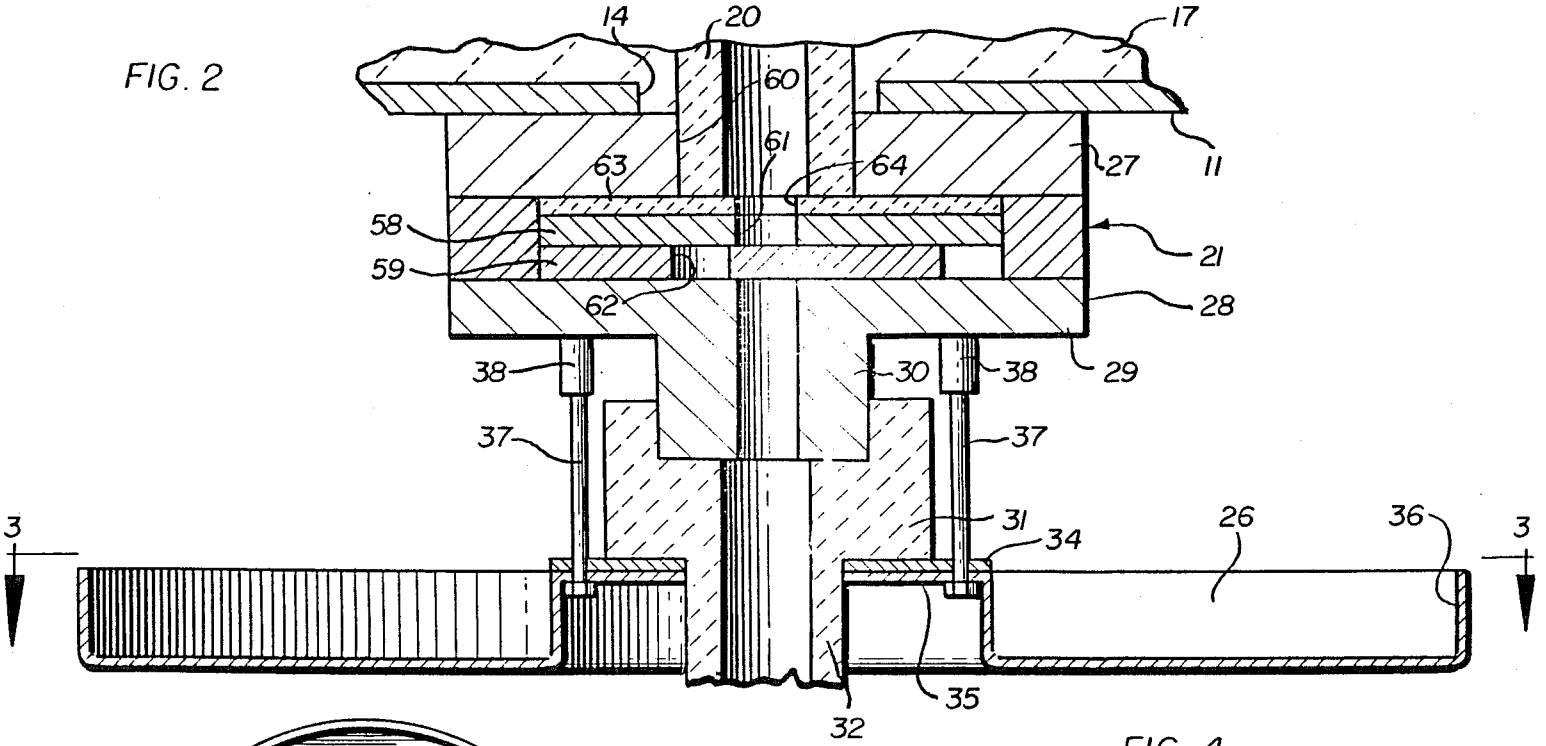
FIG. 2 is an enlarged fragmentary sectional view of a portion of the assembly shown in FIG. 1.
Figure 3:
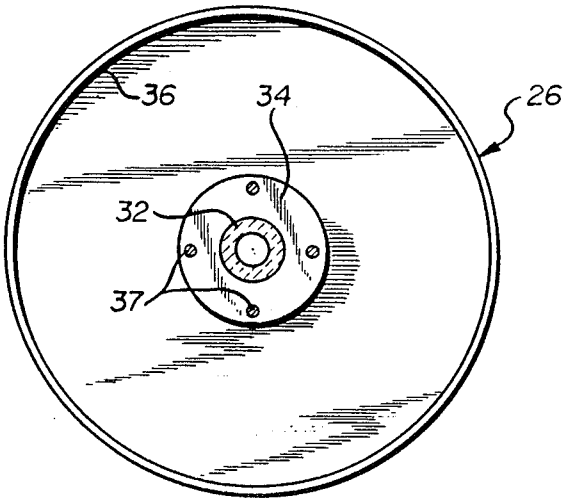
FIG. 3 is a sectional view taken along line 3--3 in FIG. 2.

Referring now to FIGS. 1-3, located between each nozzle element 20 and casting mold 22 is a drip pan 26 for catching lead dripping from the tundish. Each drip pan 26 is associated with other structure which will now be described.

Secured to tundish shell bottom 11 is a mounting plate 27 from which depends flow gate 21 which comprises a bottom portion 28 constituting a shroud holder comprising a flange 28 and a tubular part 30 engaged by an upper coupling portion 31 on a tubular shroud 32.

As noted above, gate 21 is located directly below its respective nozzle element 20 and communicates therewith for controlling the flow of molten metal from the tundish through the nozzle element to the casting mold. Tubular shroud 32 is located directly below flow gate 21 and communicates therewith for protectively directing a stream of molten metal toward casting mold 22. Drip pan 26 surrounds shroud 32 and extends in an outward direction relative to shroud 32, a distance greater than the dimensions of flow gate 21 and shroud 32 in that direction, and drip pan 26 extends to that distance around the entire periphery of flow gate 26 and tubular shroud 32. As a result, any liquid lead which drips around the outside of flow gate 21, or through the flow gate, and falls downwardly toward casting mold 22, is intercepted by drip pan 26.

Upper coupling portion 31 of tubular shroud 32 has a diameter greater than lower portions of the tubular shroud. Underlying upper coupling portion 31 is a support plate 34, and underlying support plate 34 is a raised central portion 35 of drip pan 26 which also has an upstanding peripheral rim 36. Upper coupling portion 31 on tubular shroud 32 is held in coupling engagement with tubular part 30 of shroud holder 28, by a plurality of bolts 37,37 extending upwardly through the drip pan's raised central portion 35 and through support plate 34. Bolts 37,37 have externally threaded upper ends engaged within internally threaded depending portions 38,38 extending downwardly from flange 29 on shroud holder 28. Bolts 37,37 also hold drip pan 26 in the position illustrated in FIGS. 1 and 2 wherein the drip pan is mounted to flow gate 21. The drip pan's raised central portion 35 cooperates in holding coupling portion 31 of the tubular shroud in coupling engagement with the bottom portion 28 of flow gate 21.

Figure 8:
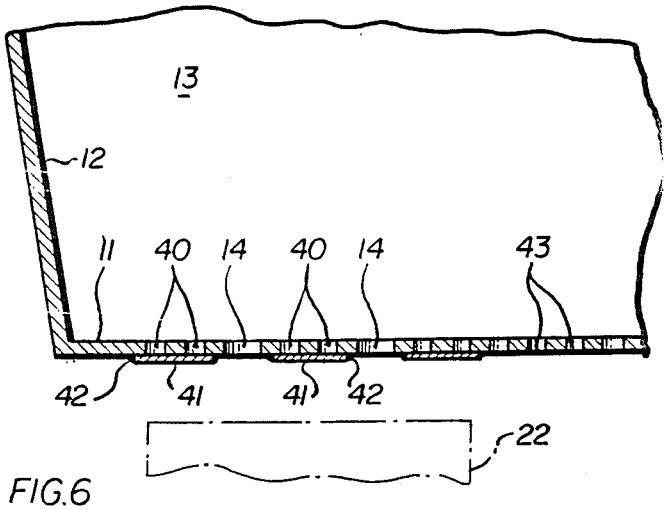
FIG. 8 is a fragmentary sectional view of an embodiment of a tundish shell in accordance with the present invention.

Located in tundish shell bottom 11 are a plurality of weep holes 40,43, (FIGS. 6 and 8) the purpose of which has been previously described. All of weep holes 40,43 are spaced from outlet openings 14,14 in the tundish shell bottom. Weep holes 40 are located relatively close to outlet openings 14,14 and overlie continuous casting mold 22. The liquid lead which finds its way to first interface 24 can drain out through weep holes 40, which overly continuous casting mold 22, and the liquid lead which drips downwardly through weep holes 40 can drop into the continuous casting mold, which is undesirable for reasons previously explained. To prevent this from occurring, sealing structure is provided for closing the weep holes which are nearest to bottom openings 14,14 including all those weep holes which overlie casting mold 22.

This sealing structure is in the form of metal plates 41,41 which abut metal, tundish shell bottom 11 and underlie each of the weep holes 40. Sealing plates 41,41 may be round or rectangular or otherwise polygonal in outline. A continuous weld 42 is provided around the periphery of each metal plate 41 for sealing the edges of the plate. This prevents liquid lead which finds its way to a weep hole 40 closed by a sealing plate 41, from working its way through the interface between the tundish shell bottom 11 and plate 41, around the outside edges of plate 41. Those weep holes which do not overlie casting mold 22 are not sealed, and these are indicated at 43 in FIG. 8.

Figure 5:
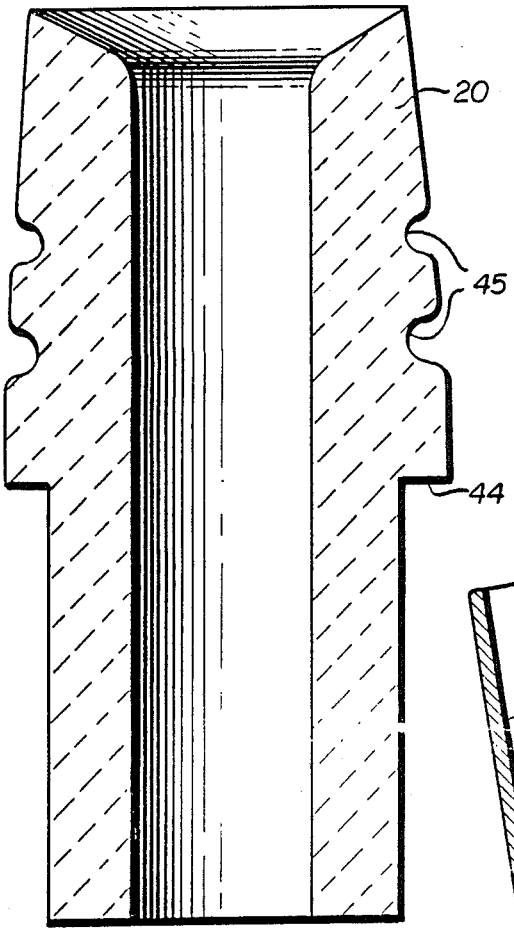
FIG. 5 is an enlarged, vertical sectional view of a nozzle element employed in accordance with the present invention.

Referring now to FIGS. 1 and 5, second interface 25, i.e., the interface between nozzle element 20 and rammed refractory material 17, has a predominantly vertical disposition, and a substantially downwardly extending lead seepage path is defined by second interface 25. Nozzle element 20 is provided with a plurality of peripheral grooves or serrations 45,45 located along second interface 25, for slowing the movement of liquid lead along that seepage path. Serrations 45,45 constitute an undulating surface on nozzle element 20 extending along second interface 25. The undulating surface at interface 25 causes liquid lead, which finds its way to that interface, to spend a relatively long time following the seepage path to opening 14, compared to the time which would be spent on a seepage path without the undulations at 45,45. This delays the lead seepage long enough to enable the completion of the casting operation before the lead seeps downwardly to a position where it can cause problems during the casting operation.

Nozzle element 20 also comprises a horizontally disposed shoulder at 44 which also contributes to slowing the movement of liquid lead along the seepage path at second interface 25.

Figure 4:
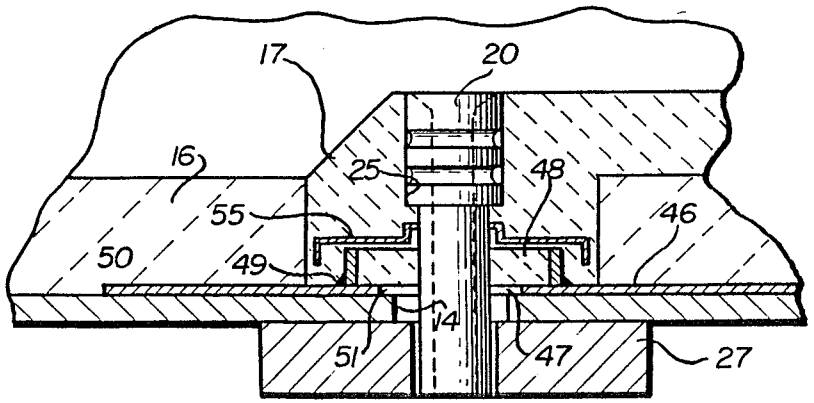
FIG. 4 is an enlarged, fragmentary sectional view of the assembly illustrating certain expedients employed in accordance with the present invention.
Figure 6:
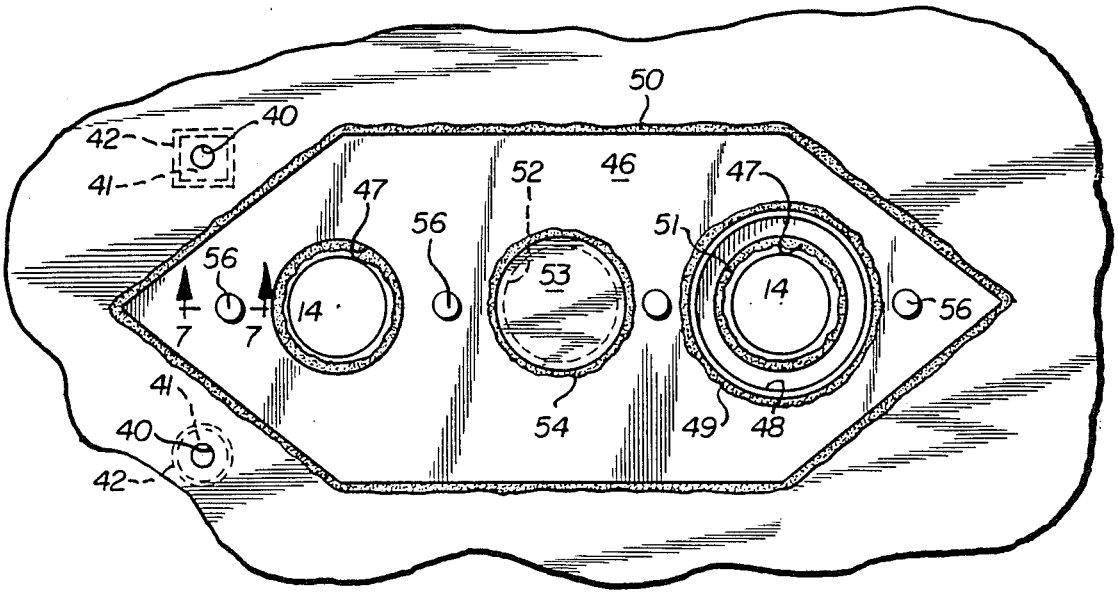
FIG. 6 is a fragmentary plan view of a portion of a tundish shell bottom employing certain expedients in accordance with the present invention.

Referring now to FIGS. 4 and 6, located atop tundish shell bottom 11 is a nut plate 46 having a pair of openings 47,47 each vertically aligned with an opening 14,14 in tundish shell bottom 11. A nozzle element 20 extends through each opening 47 in nut plate 46. Mounted atop nut plate 46, around each opening 47 is an annular dam 48 (only one of which is shown in FIG. 6). Nut plate 46 comprises structure for mounting the bottom of annular dam 48 atop tundish shell bottom 11. Each annular dam extends upwardly relative to tundish shell bottom 11 and surrounds or encircles bottom opening 14 above that opening. Each dam 48 is located within rammed refractory material 17 and surrounds or encircles at least part of nozzle element 20. Extending around the periphery of dam 48 at the bottom of the dam is a continuous weld 49 for preventing lead seepage under the dam bottom.

As shown in FIG. 1, first interface 24, i.e., the interface between tundish shell bottom 11 and refractory lining 15, extends from (a) locations remote from each bottom opening 14 to (b) that bottom opening. Dam 48 and continuous weld 49 located around the bottom of dam 48 comprise structure for preventing liquid lead seepage along first interface 24 to bottom opening 14. Continuous weld 49 is applied to nut plate 46 which is sandwiched between tundish shell bottom 11 and the bottom of dam 48.

As shown in FIG. 6, there is also a continuous weld 50 around the periphery of nut plate 46 to prevent liquid lead at first interface 24 from seeping between nut plate 46 and tundish shell bottom 11.

In addition, there is a continuous weld 51 between nut plate 46 and tundish shell bottom 11 at opening 47 in the nut plate. Continuous weld 51 is disposed along the totality of opening 47 and helps to prevent liquid lead seepage into bottom opening 14 in tundish shell bottom 11.

As noted above, nut plate 46 has two openings 47,47 and these are used when the nut plate is associated with a tundish employed for the continuous casting of billets. Some nut plates may also include an additional opening 52, located between openings 47,47 and spaced therefrom (FIG. 6). Additional opening 52 would come into use when the nut plate is included in a tundish employed for bloom casting. However, when the nut plate is included in a tundish employed for billet casting, wherein only openings 47,47 are used, additional opening 52 in the nut plate can be a source of lead seepage from above to below the nut plate, and this would be undesirable. Therefore, in accordance with the present invention, there is a closure plate 53 located atop nut plate 46 and covering additional opening 52. There is a continuous weld 54 around the periphery of closure plate 53 to prevent liquid lead seepage into additional opening 52.

The continuous welds, i.e., weld 50 around the periphery of nut plate 46, weld 49 around the periphery of annular dam 48, weld 51 at openings 47,47 and weld 54 at closure plate 53, prevent lead seepage which would occur if the continuous welds were merely tack welds.

Referring again to FIG. 4, tundish shell bottom opening 14 substantially underlies second interface 25. Extending outwardly from second interface 25, through rammed refractory material 17 is a substantially horizontal diversion shield 55. Shield 55 is composed of a material impervious to liquid lead, e.g., aluminum foil or steel foil. Diversion shield 55 extends outwardly beyond tundish shell bottom opening 14, relative to the entire periphery of the bottom opening. Shield 55 also extends outwardly beyond annular dam 48, relative to the entire periphery of the dam. Any liquid lead moving downwardly through rammed refractory material 17 is intercepted by shield 55 and diverted to a location outwardly of annular dam 48 which together with its continuous peripheral weld 49 would prevent any lead seepage inwardly toward tundish shell bottom opening 14.

Figure 7:
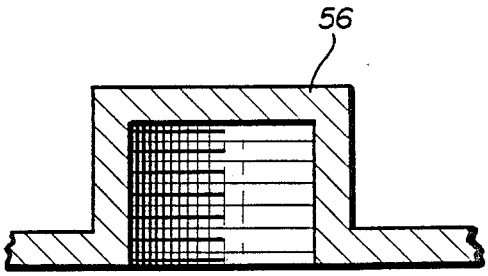
FIG. 7 is an enlarged sectional view taken along line 7—7 in FIG. 6.

Referring to FIGS. 6 and 7, nut plate 46 comprises a plurality of raised dimples 56 internally threaded for engaging bolts (not shown) extending upwardly from mounting plate 27 for securing the mounting plate underneath tundish shell bottom 11. Flow gate 21, including its bottom portion 28, are affixed to mounting plate 27 in a conventional manner (not shown). In addition to mounting plate 27 and lower portion 28, the flow gate assembly includes additional structure now to be described, with reference to FIG. 2.

Located below mounting plate 27 is a stationary flow control plate 58 having an opening 61 vertically or axially aligned with an opening 60 in mounting plate 27. Located directly below stationary plate 58 is a movable flow control plate 59 having an opening 62. The lowermost portion of nozzle element 20 extends into mounting plate opening 60. Sandwiched between mounting plate 27 and stationary flow control plate 58 is a layer of refractory mortar 63 having an opening 64 in vertical or axial alignment with opening 61 in stationary flow control plate 58. Refractory mortar layer 63 replaces a gasket composed of a blanket-like, relatively porous, refractory material previously conventionally employed in flow gates of the type described here. The layer of refractory mortar (sometimes called refractory mud) does a much better job than the previously employed gasket in preventing liquid lead seepage through the space occupied by refractory mortar layer 63.

Layer 63 is composed primarily of alumina and silica. A typical composition comprises 52.2 wt. % $Al_2O_3$, 44.0 wt. % $SiO_2$, 0.2 wt. % $Fe_2O_3$ and 3.6 wt. % alkalki oxides.

Referring now to FIG. 1, it is desirable to provide the tundish shell bottom in the vicinity of openings 14,14 with a refractory lining 15 which is relatively dense compared to refractory linings conventionally employed in the past. It is believed that a denser refractory lining takes longer to become saturated with lead, and the longer it takes to become saturated with lead, the longer it takes for the lead weeping problem to manifest itself. Once the denser refractory becomes saturated with lead, it should be replaced to avoid the lead weeping problem. In any event, whatever the mechanism, the use of a denser refractory lining increases the time for the lead weeping problem to manifest itself. A typical dense refractory composition for a lining employed in accordance with the present invention would include 95 wt. % $Al_2O_3$ compared to about 60 wt. % $Al_2O_3$ in the refractory composition previously employed. The balance of the refractory composition would be $SiO_2$ and MgO.

Referring again to FIG. 1, resting atop and extending across the interior bottom of the tundish between sidewalls 13 thereof, are a pair of elongated dams 66,66 each having a top 67. The two dams 66,66 are spaced apart in an upstream direction, relative to nozzle elements 20,20, and both are located upstream of the nozzle elements. Also extending between the sidewalls of the tundish are a pair of elongated weirs 68,68 each having a bottom 69 located above the tundish interior bottom and each being located upstream of a respective elongated dam 66. Dam top 67 is located above the height to which undissolved liquid lead accumulates on the tundish interior bottom upstream of the respective dam 66. Each weir bottom 69 is located no lower than the dam top 67 on the dam 66 downstream of that weir. Preferably, the weir bottom is located at substantially the same level as the dam top. If the weir bottom extended downwardly below the top of the dam downstream of that weir, the weir would impede the flow of molten steel toward the nozzle elements 20, 20. Each dam 66 is imperforate up to at least a height above the height to which undissolved liquid lead accumulates upstream of that dam.

With respect to the dam 66 located closest to a nozzle element 20, this dam may be provided with a drain hole 71 located slightly above the highest level at which undissolved liquid lead will accumulate on the upstream side of that dam. This relieves the pressure head of the molten steel on the lead and prevents the lead from being squeezed underneath the dam to the downstream side of the dam from where the lead can be carried out through the nozzle in large globs, which is undesirable.

The maximum height to which lead will accumulate at the upstream side of the dam 66 closest to the nozzle elements is less than about 5 cm above the tundish bottom interior surface, in a tundish 1 m long by 0.5 m wide with a depth of molten steel of about 0.6–1 m and a lead addition of about 0.38 wt. %.

In such a situation, a drain hole 71 located slightly above the highest level at which lead will accumulate would be about 5 cm above the tundish bottom interior surface. For different tundish dimensions, different molten steel depths and different percentages of lead addition, there will be different maximum heights to which lead will accumulate at the upstream side of dam 66. However, the foregoing information together with observations and experience should enable one to select the appropriate height for drain hole 71 no matter the parameters. Generally, the height for drain hole 71 would be between 3 and 10 cm.

Referring again to FIG. 1, each nozzle element 20 extends upwardly above the tundish interior bottom to a nozzle top 72. Rammed refractory material 17 slopes upwardly from the refractory lining on the tundish interior bottom to each nozzle element 20, around the entire periphery of the nozzle element. The slop on two sides of the nozzle elements is shown at 73 and 74 in FIG. 1. There are similar slopes, not shown in FIG. 1, on the other sides of the nozzle elements.

Nozzle element top 72 is located above the height to which liquid lead will accumulate on the tundish interior bottom at slopes 73 and 74. Rammed refractory material 17 slopes upwardly to substantially the height of the nozzle top. In all embodiments, the top of the sloped, rammed refractory material 17 is located above the height to which liquid lead will accumulate on the tundish interior bottom at that slope, e.g., 73 or 74. The height of nozzle top 72, and the height up to which the rammed refractory material is sloped, help to prevent liquid lead from being carried into a nozzle element 20.

By employing some or all of the expedients described above, the number of casting operations in which a tundish may be employed without being removed for rehabilitation increases substantially, e.g. by about 50%.

Referring now to FIGS. 1 and 9, extending between opposed side walls 13 of the metal tundish shell is an elongated dam shown in dash-dot lines in FIG. 1, at 75. Dam 75 extends above the interior bottom of the tundish and is located upstream of nozzle elements 72,72. Dam 75 comprises an inner core 75 composed of material, such as steel, which is impervious to liquid lead. Core 76 has a bottom 78 resting on metal tundish shell bottom 11 and a top 79 located above the highest level at which liquid lead accumulates on the upstream side of the dam. This can be determined empirically, but for the tundish dimensions and casting parameters discussed above, a top 79 which is at least 10 cm above the bottom interior surface of the tundish should suffice at virtually all locations of placement for the dam described below.

As shown in FIG. 9, dam core 76 has a pair of opposite ends 80 (only one of which is shown) each of which is in abutting relation with a respective side wall 13 of the metal tundish shell. Dam core 76 cooperates with tundish metal shell bottom 11 and side walls 13 to form a metal barrier for preventing liquid lead located upstream of dam 75 from moveing further downstream. There should be a continuous weld between dam core bottom 78 and tundish shell bottom 11, for the entire length of core bottom 78, and there should be a continuous weld between each dam core end 80 and the metal tundish side wall 13 abutted by that core end, for the entire length of the core end.

Part of dam core 76 is embedded in or enclosed by the tundish shell's refractory lining 15, adjacent shell bottom 11 and side walls 13. That part of dam core 76 extending above the tundish's interior bottom and not enclosed within refractory lining 15 is totally enclosed within an outer refractory layer 77 of dam 75.

Dam 75 may be located closer, than is shown in FIG. 1, to the location where molten metal containing liquid lead is introduced into the tundish. (The introduction location is to the right, in FIG. 1, of the weir 69 furthest upstream). In all cases, dam 75 is interposed between the introduction location for the molten metal containing the liquid lead and the nozzle elements 72,72, sufficiently upstream of the latter to prevent liquid lead from reaching locations where lead seepage into the casting mold could occur. A location relatively close to the introduction location is a preferred embodiment. In some tundishes, the introduction location is in an appendage to the main portion of the tundish, and in such a case, dam 75 could constitute a partition between the appendage and the main portion of the tundish (see FIG. 3 in said Jackson et al. application identified above).

The foregoing detailed description has been given for clearness of understanding only, and no unnecessary limitations should be understood therefrom, as modifications will be obvious to those skilled in the art.

What is claimed:

1. An assembly for the continuous casting of molten metal containing liquid lead and wherein said liquid lead is denser than the rest of the molten metal, said assembly including a tundish and comprising:

a metal tundish shell having a bottom and an opening in said bottom;

a refractory material lining the interior of said shell bottom to form a tundish interior bottom;

a vertically disposed nozzle element separate and discrete from said shell and said lining and extending through said lining material and said opening in the shell;

said tundish having a pair of sidewalls and a pair of endwalls;

an elongated dam resting atop and extending across the interior bottom of said tundish between said pair of tundish sidewalls, said elongated dam being located upstream of said nozzle element;

said dam comprising means for accumulating liquid lead on the upstream side of said dam;

and pressure-relieving means on said dam, for relieving the pressure head of the molten metal on said liquid lead accumulating on the upstream side of said dam to prevent the lead from being squeezed underneath the dam to the downstream side of the dam;

said pressure-relieving means comprising a drain hole located slightly above the highest level at which said liquid lead will accumulate on said upstream side of the dam;

the walls of said tundish having a containment height for containing molten metal having a depth of at least 600 cm;

the ratio of drain hole height on the dam to said containment height of the tundish walls being no greater than about 10/600.

2. An assembly for the continuous casting of molten metal containing liquid lead and wherein said liquid lead is denser than the rest of the molten metal, said assembly including a tundish and comprising:

a metal tundish shell having a bottom and an opening in said bottom;

a refractory material lining the interior of said shell bottom to form a tundish interior bottom;

a vertically disposed nozzle element separate and discrete from said shell and said lining and extending through said lining material and said opening in the shell;

said tundish having a pair of sidewalls and a pair of endwalls;

an elongated dam resting atop and extending across the interior bottom of said tundish between said pair of tundish sidewalls, said elongated dam being located upstream of said nozzle element;

said dam comprising means for accumulating liquid lead on the upstream side of said dam;

and pressure-relieving means on said dam, for relieving the pressure head of the molten metal on said liquid lead accumulating on the upstream side of said dam to prevent the lead from being squeezed underneath the dam to the downstream side of the dam;

said pressure-relieving means comprising a drain hole located slightly above the highest level at which said liquid lead will accumulate on said upstream side of the dam;

said drain hole being located 3–10 cm above said tundish interior bottom.

* * * * *